US006386365B1

(12) United States Patent
Tan

(10) Patent No.: US 6,386,365 B1
(45) Date of Patent: May 14, 2002

(54) NESTING STACKING CRATE

(76) Inventor: Hong Sin Tan, Blk 328 Yishun Ring Road, #11-1368, Singapore 760328 (SG)

( * ) Notice: Subject to any disclaimer, the term of this patent is extended or adjusted under 35 U.S.C. 154(b) by 0 days.

(21) Appl. No.: 09/843,222

(22) Filed: Apr. 26, 2001

(51) Int. Cl.[7] ..... B65D 21/06

(52) U.S. Cl. ..... 206/506; 206/505

(58) Field of Search ..... 206/505, 506, 206/503

(56) References Cited

U.S. PATENT DOCUMENTS

| | | | | | |
|---|---|---|---|---|---|
| 986,265 | A | * | 3/1911 | Boss | 206/506 X |
| 2,244,841 | A | * | 6/1941 | Johnson | 206/506 |
| 5,083,666 | A | * | 1/1992 | Lam | 206/506 |
| 5,494,163 | A | * | 2/1996 | Apps | 206/506 |
| 6,059,114 | A | * | 5/2000 | Lottus | 206/506 |

* cited by examiner

*Primary Examiner*—Steven Pollard
(74) *Attorney, Agent, or Firm*—Brown & Michaels, PC

(57) ABSTRACT

A nesting stacking crate comprises a base member and upwardly outwardly flaring collapsible side walls and end walls, as well as semi-hexagonal corner members, all terminating at the top in a top rim. Attached to the top end of each hexagonal corner member is a stacking-support member consisting of a support housing, preferably shaped substantially like a capital H, and a support blade hingedly connected thereto which flips about the crossbar of the H, between a nesting condition and a stacking condition. In the nesting condition, the blades are rotated outwardly downwardly and lie extrinsic to the interior of the crate, thus allowing another like crate to be nested inside. In the stacking condition they are rotated inwardly horizontally pointing generally diagonally towards the opposite corner of the crate. In that condition the support blades provide a support base for another like crate to be stacked on top for transportation and storage of goods. In such condition the hexagonal corners absorb the weight of the stacked crate, the corners being stronger than conventional half-square corners. Preferably, the base has, attached to its lower surface, hollow feet adapted to receive the blades of a forklift truck, and such feet have indentations adapted to receive the support blades of a crate beneath when the latter is in the stacking condition.

5 Claims, 5 Drawing Sheets

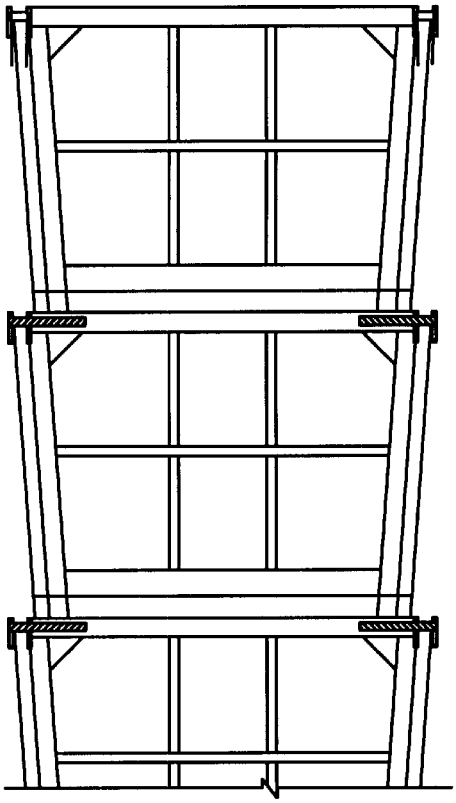
Fig. 10
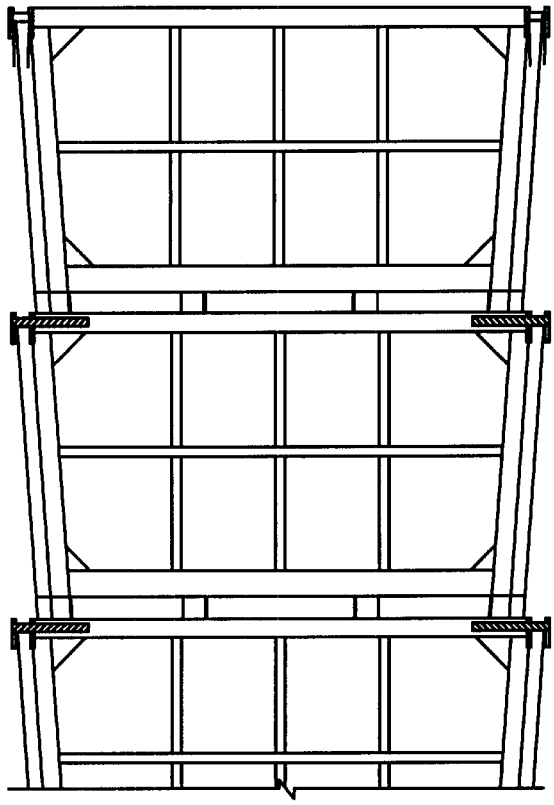
Fig. 11
Fig. 13
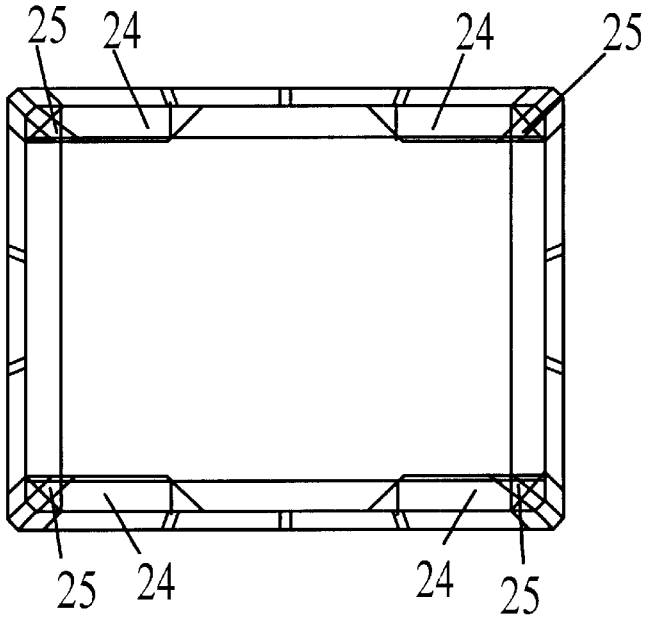

NESTING STACKING CRATE

BACKGROUND OF THE INVENTION

1. Field of the Invention

The invention pertains to the field of nesting stacking containers. More particularly, the invention pertains to a nesting crate with hexagonal corners each having a support member for stacking.

2. Description of Related Art

Bins, crates, and other containers, especially those intended for industrial or commercial use, are employed to contain and/or transport a variety of products, parts or raw materials. Stackability of filled bins or crates is desirable for efficient use of space during transportation or storage of such goods. When stacked, it is important to ensure that the crates do not move laterally or slide off the next-lower crate. Stability of stacking is easily achieved with non-nesting crates. Nesting of empty crates is also desirable so that the crates occupy less space and are easily moved in bulk. Manifestly, however, nestability requires the crate to be wider at the top than at the bottom, precluding the type of stacking mentioned above.

Several nesting, stacking containers are known in the art. One method of achieving stackability of nesting containers consists of providing retractable laterally-projecting support members at the base of the container. An example is shown in U.S. Pat. No. 4,872,574, CONTAINER (Lam 1989), one embodiment of which includes rectangular extension members housed in slots at the four corners of the base and arranged to be slid outwardly to provide stability of stacked containers. Each extension member has a downwardly-projecting flange to prevent collapse of stacked containers by preventing excessive relative displacement in a lateral direction.

Another method of stacking nesting containers entails providing support members, such as flaps or rods, at the top rim of each container to support a similar container stacked above it. Several examples of such are shown in the art. In U.S. Pat. No. 4,872,574, referred to above, an alternate embodiment of the apparatus disclosed therein includes support protrusions fused onto the rim in four locations near the corners. These are not ideal, however, as their fusion to the top rim interferes with nesting of empty containers.

Such disadvantage is absent in devices where the support member rotates for positioning outside of the interior space of the container, as disclosed in U.S. Pat. No. 2,765,099, LUG BOX (Lively 1956). That patent shows a container having hinged wings or leaves connected to the upper edge of each end wall, which rotate about a hinge disposed at the top of the end wall. When the wings are placed in a vertical position the containers nest one within another; when they are placed in a horizontal position pointing inwardly from the top rim of the end wall, the containers stack one on top of another.

A similar approach is taken in U.S. Pat. Nos. 2,293,966, RECEPTACLE (Best 1942) and 3,659,743, PLASTIC NESTING AND STACKING CASE (Box 1972), but instead of wings or leaves, corner irons or brackets flip along an axis just below and parallel to the top rim of the end walls or side walls, to rest upon the side walls or end walls (respectively) and provide support for the crate stacked upon it. The brackets are flipped back to the outside of the container for nesting.

PCT international published application WO 89/09168, PCT/GB89/00303, CRATES FOR TRANSPORTING RUBBER BLOCKS OR SHEETS (Shaw, international publication date Oct. 5, 1989) discloses a stacking nesting crate having hinged support members located near the corner of the crate, each such member having a blade hinged about an axis parallel to the longitudinal axis of the top rim. When not in use, the blade extends outwardly downwardly extrinsic to the crate's interior. When flipped, or rotated about its axis, the hinged support member lies in a substantially horizontal position extending inwardly towards the opposite side wall of the crate to support the base of an overlying crate. Although the support members are positioned near the corners, they are nevertheless embedded in the crate wall and extend outwardly perpendicularly therefrom. The disadvantage of such an arrangement is that the horizontal component of the downward/inward force vector resulting from stacking another crate on top is substantially perpendicular to the wall housing the support member, resulting in a risk of deformation of or breakage from the wall if the weight being supported becomes too heavy. There is additionally a risk of deformation or breakage of the half-square corner members, which are inherently weaker than corner members that are half-hexagonal in horizontal cross section (see below).

All of the above devices have square corners, whereby each corner has only two sides. Non-square corners, as for example semi-hexagonal corners, provide added strength to a container. U.S. Pat. No. 4,984,734, STACKABLE ARTICULATED CARTON TRAY APPARATUS (Zion 1991) discloses a stackable cardboard pizza carton with three-sided corners that are substantially hexagonal or octagonal in shape, to effectively retain a substantially circular pizza pie and support a similar carton stacked above it. The device is primarily designed for stacking of multiple food products for delivery to the consumer, and does not have a rigid frame.

In addition to square corners being inherently weaker than hexagonal corners, there are two additional benefits to hexagonal corners. First, hexagonal corners allow placement of the stacking-support member in the middle of the corner member instead of merely near the corner member or on one side of the corner member. This provides for extra support from all of the corner member's sides-the middle side as well as the two outer sides of the semi-hexagon-of the weight placed on top. Second, when the crate is placed in the nesting configuration, the support blades extend outwardly downwardly to the corner rather than to the side or end of the crate. This means that the outwardly-downwardly extending support blades occupy a gap that the hexagonal corner carves out of the square corner that would otherwise be present, and so multiple stacks of nested crates can be placed side-by-side and/or end-to-end without the outwardly-downwardly extending support blade getting in the way. Finally, it is noted that with support blades placed in the middle of a hexagonal corner, in the stacking position the blades extend diagonally generally towards the opposite corner of the crate rather than toward the opposite side wall.

Accordingly, while nesting crates with support members for stackability are known in the art, none include non-square corners designed to provide added strength to the corner. A fortiori, none comprise support members extending from non-square corners for added stacking-support strength.

SUMMARY OF THE INVENTION

The present invention comprises a substantially rectangular crate having upwardly outwardly flaring collapsible side walls and end walls which terminate at the top in a top rim. The invented crate also includes a base with an upper surface and a lower surface, the lower surface preferably having spaced hollow feet each adapted to receive the blade of a forklift truck underneath each side or end wall. The invented crate further includes corner members disposed between each pair of adjacent walls. The corner members extend upwardly outwardly from the bottom of the crate and include three sides, preferably forming in cross section a semi-hexagon. Such corner members are hereinafter referred to as "hexagonal corners."

Each hexagonal corner has a stacking-support member disposed near the top thereof, which includes an H-shaped stacking-support housing and a support blade rotatably mounted upon the crossbar of the H. The support blade rotates about the cross bar, which lies along an axis parallel to the middle side of the corner when viewed in cross-section. The top of the 'H' is preferably at approximately the same height as the top of the crate's rim, with the crossbar being below that height.

In the nesting configuration, the crate's support blades are rotated outwardly downwardly and remain extrinsic to the interior of the crate for nesting. In the stacking configuration, the blades are rotated about the crossbar of the stacking-support housing such that they point inwardly horizontally and diagonally across generally toward the center of the crate, to support the base of another crate. They are thus positioned within a plane parallel to the plane containing the top of the crate's rim, but slightly below it due to the cross bar of the 'H' being below the top of the 'H'. In this configuration another similar crate can be stacked upon the first crate for convenience of transport or storage of goods, with the bottom of the upper crate resting upon the support blades of the lower crate. Because the plane of the lower crate's support blades is below the top edge of the crate's rim, the upper crate is prevented from moving laterally or sliding off the crate beneath. For further stability of stacked crates, it is preferable that the feet of each crate have depressions or indentations that match the stacking-support blades of a crate below when the latter is in the stacking configuration.

BRIEF DESCRIPTION OF THE DRAWING

FIG. 10 is an end view of several stacked crates.

FIG. 11 is a side view of several stacked crates.

FIG. 13 is a bottom view of the invented crate.

DETAILED DESCRIPTION OF THE INVENTION

Figure 1:
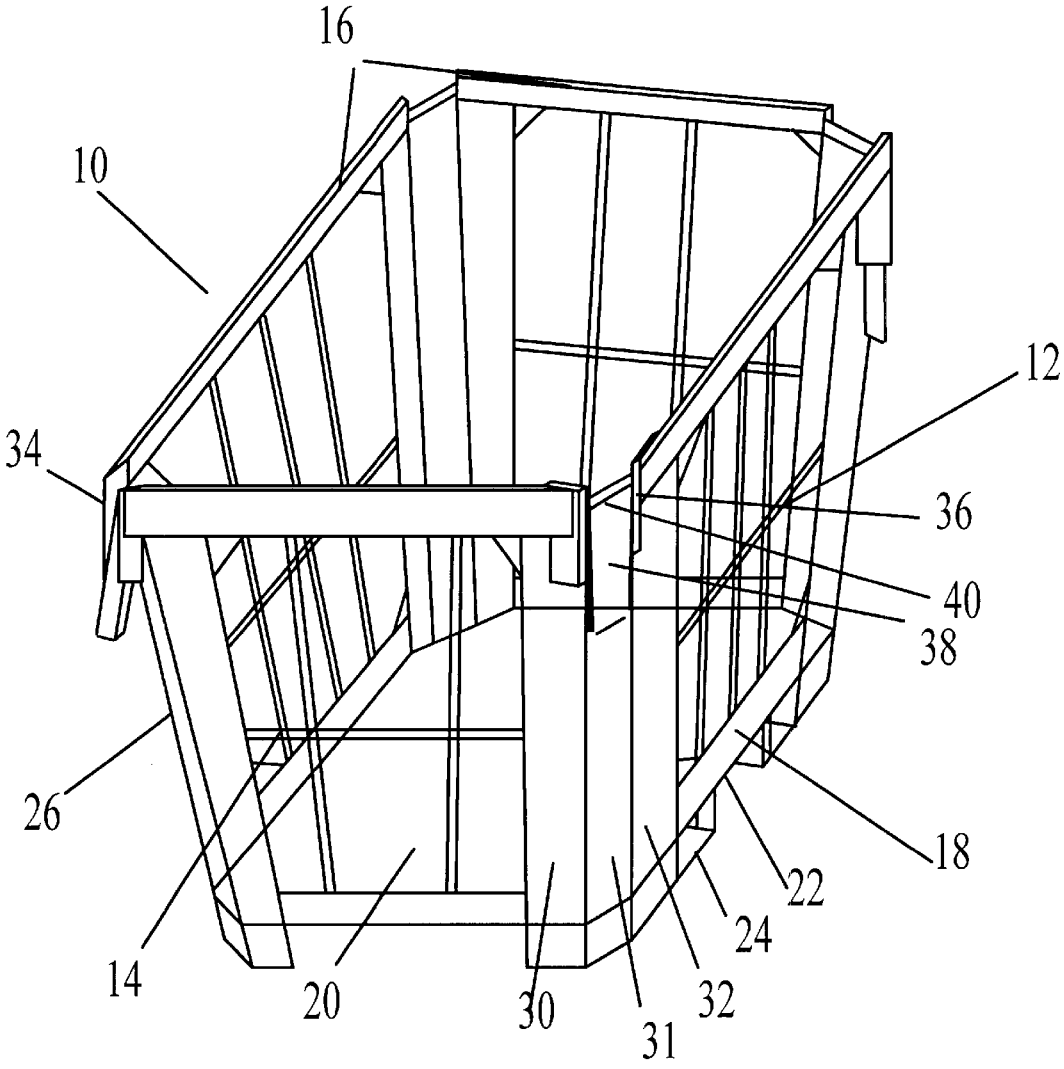
FIG. 1 shows an isometric view of the invented crate having hexagonal corners.

To assist in a better understanding of the present invention, a specific embodiment of the invention will now be described in detail. Although such is the preferred embodiment, it is to be understood that the invention can take other embodiments. This detailed description of the invention will include reference to FIGS. 1 through 13. The same reference numerals will be used to indicate the same parts and locations in all the figures unless otherwise indicated. It will be apparent to one skilled in the art that the present invention may be practiced without some of the specific details described herein. In other instances, well-known structures and devices are shown in block diagram form.

Referring now to FIG. 1, the invented crate (10) is composed of upwardly outwardly flaring collapsible side walls (12) and end walls (14) which terminate at the top in a top rim (16). For convenience, the walls (12) and (14), respectively, are arbitrarily referred to throughout the present specification as side walls and end walls. It should be understood, however, that these terms can be used interchangeably, and that the relative dimensions of the side walls and end walls is not important. The walls (12, 14) are connected to a base (18) having an upper surface (20) and a lower surface (22), the lower surface preferably having spaced hollow feet (24) each adapted to receive the blade of a forklift truck (not shown). Preferably, the above-described components of the crate (10) are formed from high-density polyethylene or other suitably polymeric materials. However, these components could be formed from other materials without departing from the scope of the invention.

The invented crate (10) also includes four corner members (26), each disposed between a pair of adjacent walls (12, 14). The corner members (26) extend upwardly outwardly from the bottom of the crate (10) and include three sides (30, 31, 32), preferably forming in cross section a semi-hexagon. The half-hexagonal structure enhances the strength and durability of the crate. Each such hexagonal corner member (26) includes a stacking-support member (34) disposed near the top thereof, which includes a substantially vertically-oriented H-shaped stacking-support housing (36) and a support blade (38) hingedly mounted upon the crossbar (40) of the H. The support blade (38) rotates about the cross bar (40), which lies along a horizontal axis parallel to the middle side (31) of the corner member (26). The top of the stacking-support housing (36) is preferably located at approximately the same height as the crate's top rim (16). The axis about which the support blade (38) rotates is therefore below the top rim (16).

Figure 2:
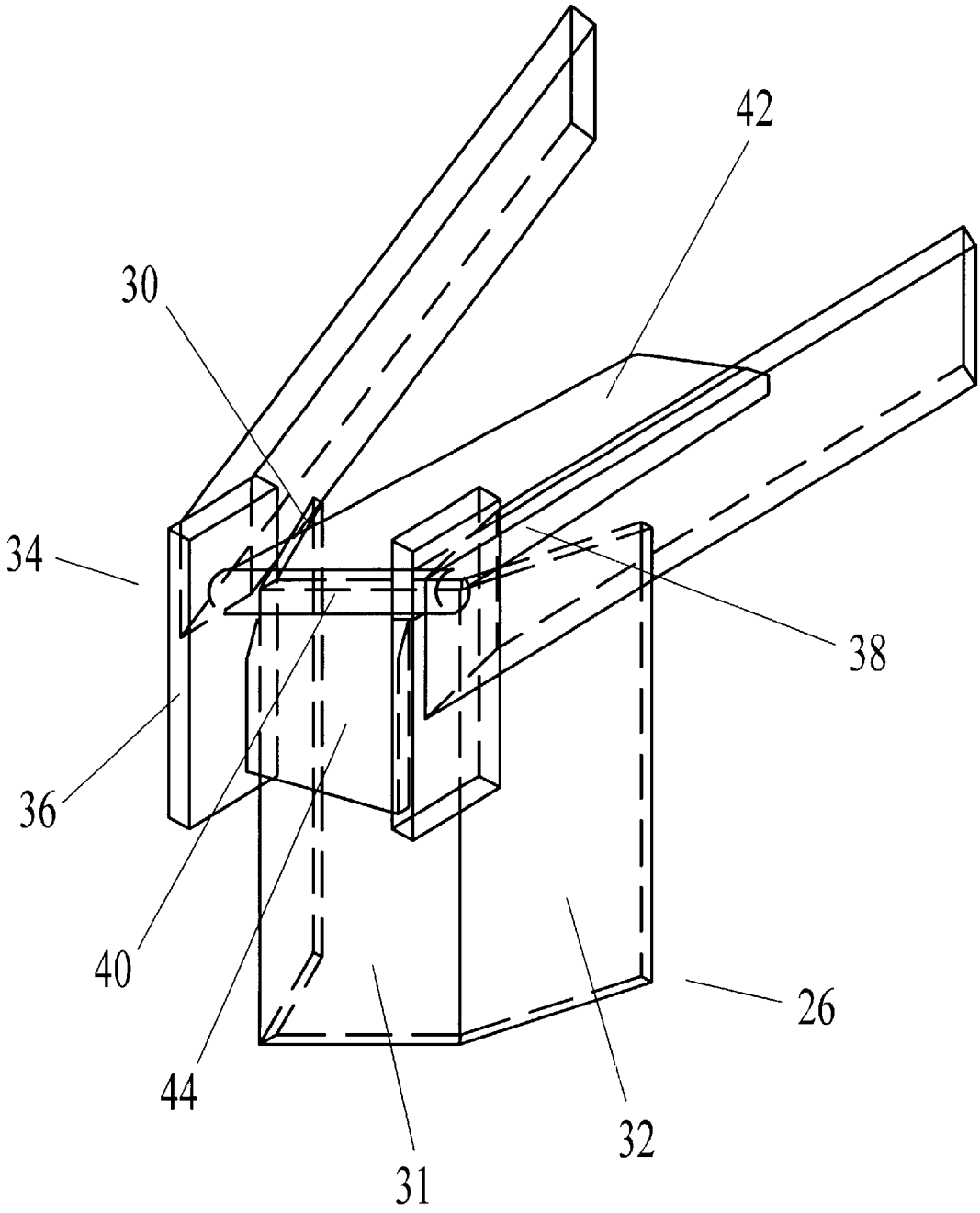
FIG. 2 is an enlarged fragmentary view of the stacking-support member at the hexagonal corners of the invented crate, in the stacking configuration.
Figure 3:
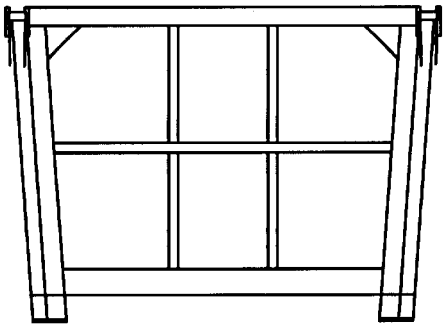
FIG. 3 is an end view of a single crate in the nesting configuration.
Figure 4:
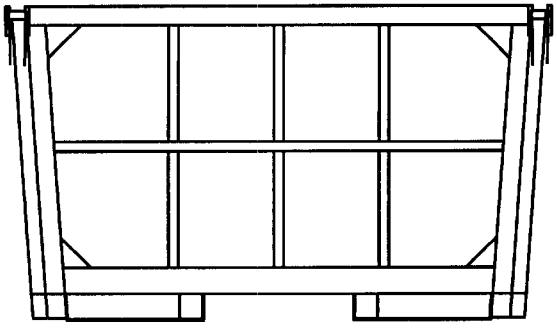
FIG. 4 is a side view of a single crate in the nesting configuration.
Figure 5:
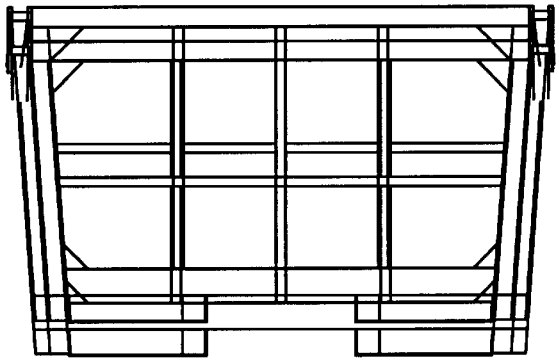
FIG. 5 is a side view of two nested crates.
Figure 6:
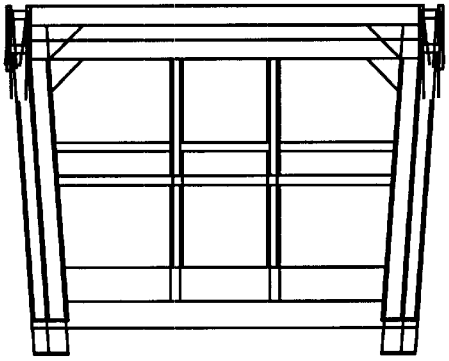
FIG. 6 is an end view of two nested crates.
Figure 7:
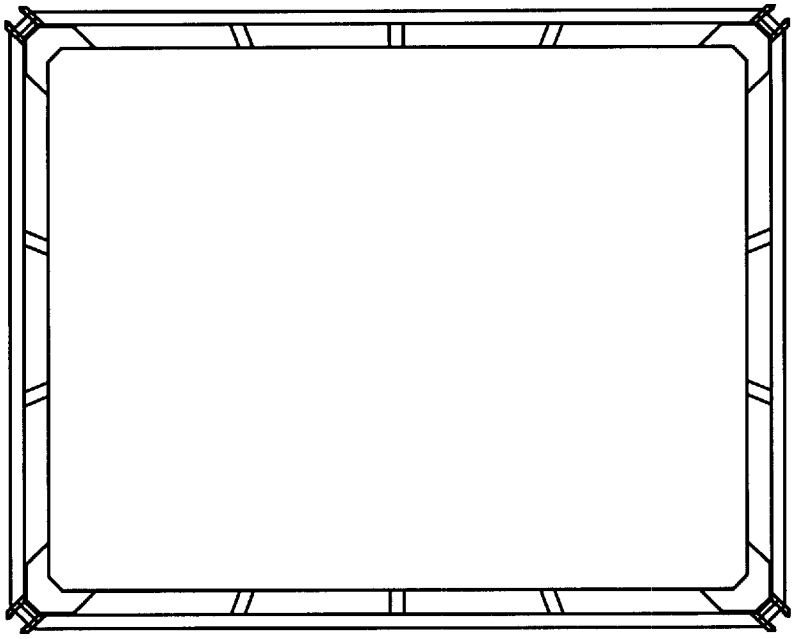
FIG. 7 is a top view of a single crate in the nesting configuration.

FIG. 2 is an enlarged fragmentary view from outside the crate showing the structure of the stacking-support member (34) in the stacking configuration. The same stacking support member (34) can be seen in the nesting configuration in FIGS. 3–6. In the nesting configuration, the support blades (38) extend outwardly downwardly and remain extrinsic to the interior of the crate (10), so that an identical empty crate can be nested inside it. FIGS. 3 and 4 are end and side views, respectively, of a single crate in this configuration. FIGS. 5 and 6 are side and end views, respectively, of two nested crates in this configuration. FIG. 7 is a top view of a crate in this configuration.

Referring again to FIG. 2, in the stacking configuration of the stacking-support member (34), the blade (38) is rotated about the crossbar (40) of the stacking-support housing (36) such that it points inwardly horizontally, and diagonally generally towards the opposite corner of the crate, to support the crate stacked on top. Each support blade (38) has a substantially "diving board" shape with a horizontal portion (42) and a vertical portion (44). When a crate is placed (stacked) upon the receiving crate, the weight of the stacked container pushes down upon the horizontal portion (42), thus causing, through pivoting action about the crossbar (40), force to be exerted backward by the vertical portion (44) and downward and inward by the crossbar (40). Unlike prior art crates, the stacking-support members (34) of the invented crate (10) are located within the hexagonal corners for added strength. The downward weight of the upper crate is thus placed upon corners that are stronger than the half-square corners of prior art crates. In this configuration all four blades (38) are positioned within a plane parallel to the plane containing the top rim, but below it due to the cross bar (40) being below the top of the 'H'. The overlaying crate's feet cause its weight to be distributed evenly to all the upright hexagonal corner members (26) of the lower crate, thus enhancing the stability of the lower crate. Accordingly, there are three sides (30, 31, 32) to each corner to absorb the downward/inward force exerted by the stacking-support member (34). The angle between the horizontal component of the force vector of the crossbar (40) and the two outer sides (30, 32) of the hexagonal corner member (26) is significantly less than 90 degrees, thus minimizing the risk of deformation of or breakage from the corner members (26) that house the stacking-support members (34).

Figure 8:
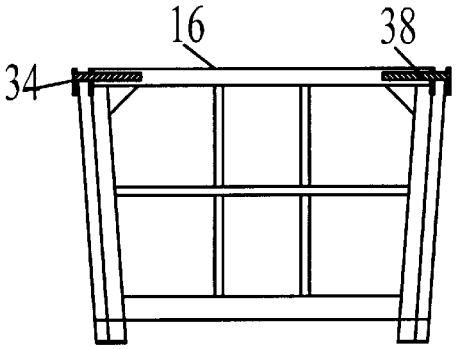
FIG. 8 is an end view of a single crate in the stacking configuration.
Figure 9:
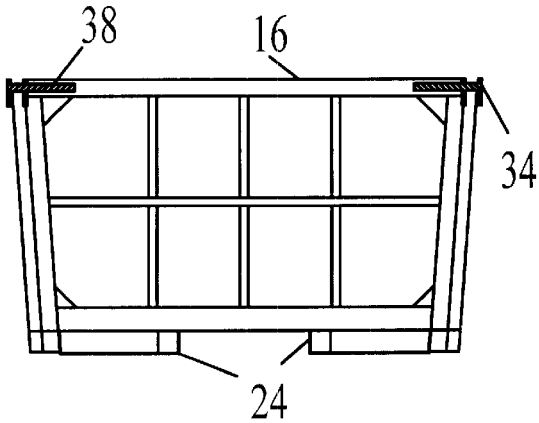
FIG. 9 is a side view of a single crate in the stacking configuration.

FIGS. 8 and 9 show end and side views, respectively, of the invented crate with the stacking-support members (34) in the stacking configuration. In this configuration another similar crate can be stacked upon the first crate for convenience of transport or storage of goods, with the bottom of the upper crate resting upon the support blades (38) of the lower crate. Because the plane of the lower crate's support blades (38) is below the top rim (16), the upper crate is prevented from moving laterally or sliding off the lower crate upon which it is stacked. Preferably, as well, the bottom surface of the feet contain depressions or indentations that match the shape of the blades, for further assurance against lateral movement of the stacked crate. This can be seen in FIG. 13, which shows a view of the invented crate looking upward from underneath. The spaced hollow feet (24) contain slight, generally diagonally-pointing, indentations (25) that match the shape of the support blades of a crate underneath when those support blades are rotated such that they are in the stacking position.

Figure 12:
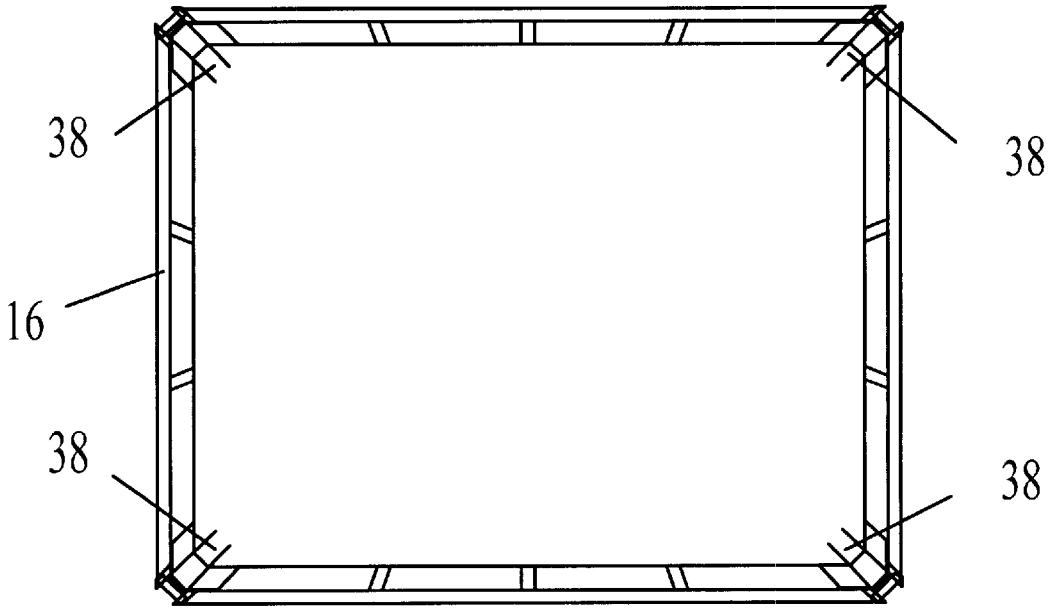
FIG. 12 is a top view of a single crate in the stacking configuration.

Referring to FIG. 12, a top view of a crate in the stacking configuration is provided. In this configuration the support blades (38) do not extend backwards beyond the outer edge of the rim (16), thus enabling the rims of adjacent crates to be placed flush against each other for optimal loading during storage and transport of filled crates. FIGS. 10 and 11 are end and side views, respectively, of multiple stacked crates in this configuration, albeit the top crate has its stacking-support members in the nesting configuration as no crate is stacked on top of it. To stack a crate on top of the top crate, one need simply flip (by hand) the four support blades at the corners into the stacking position, and then place the overlying crate on top of the stack.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A nesting stacking crate for storage or transportation of goods comprising:

a) a base having an upper surface and a lower surface, the lower surface having a plurality of hollow feet spaced apart to receive lift truck forks for lifting and conveyance;

b) four walls connected to the base comprising two upwardly and outwardly flaring side walls facing each other and two upwardly and outwardly flaring end walls facing each other;

c) four upwardly and outwardly flaring corner members having three sides, a top end and a bottom end, each being substantially semi-hexagonal in horizontal cross section, wherein each corner member is disposed between and connected to a pair of adjacent walls, the tops of the four walls and the tops of the four corner members collectively forming a top rim; and d) four stacking-support members, one attached to the top end of each corner member, wherein each stacking support member has a stacking-support housing and a support blade hingedly attached thereto which is pivotally movable from a stacking condition in which the blade extends substantially horizontally and diagonally across generally toward an opposite corner member of the crate, to a nesting condition in which the blade extends outwardly downwardly from the rim;

so that with the blades of the stacking-support members in the stacking condition an overlying crate is receivable inside the top rim with the blades of the stacking-support members supporting the overlying crate, and with the blades of the stacking-support members in the nesting position, the overlying crate may nest inside the crate with the base of the overlying crate substantially adjacent to the base of the receiving crate.

2. The crate of claim 1 wherein the stacking-support housing is shaped substantially as a capital H and the blade attached thereto pivots about a crossbar of the capital H.

3. The crate of claim 1 wherein the support blade, when in the stacking condition, lies in a plane below a plane containing the top rim so that the top rim prevents another crate stacked on the crate from moving laterally or sliding off of the crate.

4. The crate of claim 2 wherein each foot has a bottom surface containing a depression adapted to receive a support blade of another like crate beneath it when the support blades of the crate beneath are in the stacking condition.

5. The crate of claim 1 wherein the base, feet, walls, and corner members are formed from high-density polyethylene.

* * * * *